US006116935A

United States Patent [19]

Fukuda

[11] Patent Number: 6,116,935

[45] Date of Patent: Sep. 12, 2000

[54] CONNECTOR EXAMINATION INSTRUMENT

[75] Inventor: Eiji Fukuda, Shizuoka, Japan

[73] Assignee: Yazaki Corporation, Tokyo, Japan

[21] Appl. No.: 09/287,656

[22] Filed: Apr. 7, 1999

[30] Foreign Application Priority Data

Apr. 8, 1998 [JP] Japan ..... 10-095940

[51] Int. Cl.[7] ..... H01R 13/62

[52] U.S. Cl. ..... 439/310; 324/538

[58] Field of Search ..... 324/538, 761; 439/310, 488, 489, 701

[56] References Cited

U.S. PATENT DOCUMENTS 5,429,519 7/1995 Murakami et al. ..... 439/310
5,467,023 11/1995 Takeyama ..... 439/310 X
5,512,833 4/1996 Fukuda et al. ..... 324/538
5,689,191 11/1997 Kashiyama ..... 324/538

*Primary Examiner*—Khiem Nguyen
*Attorney, Agent, or Firm*—Sughrue, Mion, Zinn, Macpeak & Seas, PLLC

[57] ABSTRACT

In a connector examination instrument, a connector support member and an examination instrument body are provided for movement toward and away from each other, and examination pins are slidably mounted within the examination instrument body, and are spring biased toward the connector support member. Each of the examination pins includes a conducting contact surface for contact with an associated metal terminal within a connector, and an incomplete insertion-detecting projection for insertion into a flexure space for an elastic retaining piece portion for retaining the metal terminal. Each of the examination pins comprises a shank, having an exposed distal end serving as the conducting contact surface, and an insulative shaped member which is fixedly secured to the distal end portion of the shank, and has the incomplete insertion-detecting projection.

2 Claims, 5 Drawing Sheets

CONNECTOR EXAMINATION INSTRUMENT

BACKGROUND OF THE INVENTION

1. Field of the Invention

This invention relates to a connector examination instrument used in the examination of a connector for a wire harness of an automobile, and more particularly to an improved examination pin for detecting an electrical connection of a terminal and an inserted condition of the terminal.

The present application is based on Japanese Patent Application No. Hei. 10-95940, which is incorporated herein by reference.

2. Description of the Related Art

FIGS. 4 to 6 show a connector examination instrument disclosed in Japanese Patent Publication No. Hei. 7-113836. earlier proposed by the Applicant of the present application.

In the connector examination instrument A' shown in FIG. 4, a fixed wall 2, having a wire outlet port 2*a,* is formed upright at one end of a base plate 1, and an examination instrument body 3 is provided at the other end portion of the base plate 1 for movement toward the fixed wall 2. This body 3 is moved back and forth in accordance with the movement of a pivotally-movable operating lever 5.

A connector support member 6 is provided between the fixed wall 2 and the examination instrument body 3. The connector support member 6 has a frame-like shape, and has a connector receiving chamber 6 which is open at its top and at that side thereof facing the examination instrument body 3. A wire outlet port 6*b* is formed in that side of the connector support member 6 facing the fixed wall 2. The connector support member 6 is urged toward the examination instrument body 3 by coil springs 8 wound respectively on guide levers 7 extending from the fixed wall 2 into the connector support member 6. When the connector support member 6 is pressed by the examination instrument body 3, the connector support member 6 is moved rearward against the bias of the coil springs 8.

A connector B is inserted into the connector support member 6 from the upper side, and at this time wires $W_1$ extending from a rear side of this connector, are received in the wire outlet ports 6*b* and 2*a*.

As shown in FIG. 5, a plurality of examination terminals 10, corresponding respectively to a plurality of terminal receiving chambers 9 in the connector B, are provided within the examination instrument body 3. An examination pin D', made of electrically-conductive metal, is slidably mounted in the examination terminal 10, and is urged and projected into an examination chamber 13, formed in a front portion of the body 3, by a coil spring 20.

A head 11', having a conducting contact surface 11*a,* is formed at a distal end of a shank 11*e* of the examination pin D', and an incomplete insertion-detecting projection 11*b* is formed at a lower portion of the head 11', and extends forwardly. The shank 11*e,* the head 11' and the projection 11*b* are formed integrally with each other, using electrically-conductive metal. Each of the examination terminals 10 is connected to a checker (not shown) via a lead wire $W_2$ (FIG. 4).

A slanting abutment surface 11*c* is formed at a distal end of the incomplete insertion-detecting projection 11*b* at an outer surface thereof. A slanting guide surface 19*a* for the slanting abutment surface 11*c* is formed at a front end of a housing wall 19 of the terminal receiving chamber 9 having an elastic retaining piece portion 14 formed thereon. The examination pin D' is supported at its proximal end portion so as to be tilted relative to the examination terminal 10 in a direction intersecting the axial direction, and the slanting abutment surface 11*c* is abutted against the slanting guide surface 19*a* so that the examination pin can be positively guided into a flexure space 16 for the elastic retaining piece portion 14 within the housing.

For effecting the examination, the operating lever 5 (FIG. 4) is pivotally moved to advance the examination instrument body 3, so that this body 3 receives a front portion of the connector B therein, and the head 11' of each examination pin D' is brought into contact with an associated metal terminal C. In FIG. 6, the metal terminal C in the lower terminal receiving chamber 9 in the connector B is completely inserted, and a retaining projection 14*a* of the elastic retaining piece portion 14 is fitted in a retaining hole 15 in the metal terminal C, and therefore the elastic retaining piece portion 14 is completely restored into its original condition. However, the metal terminal C' in the upper terminal receiving chamber 9 is incompletely inserted, and the elastic retaining piece portion 14 is kept displaced downwardly through the retaining projection 14*a*.

When the connector B in this condition is examined, the incomplete insertion-detecting projection 11*b* of the examination pin D', corresponding to the metal terminal C, enters the flexure space 16 for the elastic retaining piece portion 14, so that the conducting contact surface 11*a* contacts the distal end of the metal terminal C, thereby conducting an electric circuit for examination purposes. However, the incomplete insertion-detecting projection 11*b* of the examination pin D', corresponding to the upper metal terminal C', abuts against the distal end of the elastic retaining piece portion 14, so that the advance of the examination pin D' is prevented, and the conducting contact surface 11*a* is held out of contact with the metal terminal C'. Therefore, an electric circuit for examination purposes is not in a conducting condition, and this incomplete insertion is judged by the checker.

In the above conventional connector examination instrument A', the conducting contact surface 11*a* for abutment against the distal end of the metal terminal C', as well as the incomplete insertion-detecting projection 11*b* for abutment against the elastic retaining piece portion 14, is formed integrally with the shank 11*e* of the examination pin D', using electrically-conductive metal. Therefore, when the examination pin D' is inserted obliquely as shown in FIG. 7, the incomplete insertion-detecting projection 11*b* is brought into contact with the metal terminal C', thus causing a detection error.

SUMMARY OF THE INVENTION

It is an object of this invention to provide an improved connector examination instrument in which even if an examination pin is inserted obliquely, a detection error will not be encountered.

The above object has been achieved by a connector examination instrument, wherein a connector support member and an examination instrument body are provided for movement toward and away from each other. Examination pins are slidably mounted within the examination instrument body, and are spring biased toward the connector support member. Each of the examination pins includes a conducting contact surface for contact with an associated metal terminal within a connector, and an incomplete insertion-detecting projection for insertion into a flexure space for an elastic retaining piece portion for retaining the metal terminal. Each of the examination pins comprises a shank, having an exposed distal end serving as the conducting contact surface, and an insulative shaped member which is fixedly secured to the distal end portion of the shank, and has the incomplete insertion-detecting projection.

The shank of the examination pin and the insulative shaped member are formed separately from each other, and the two are connected together by press fitting or the like. Therefore, even if the examination pin is inserted obliquely, so that the incomplete insertion-detecting projection of the shaped member is brought into contact with the metal terminal, a conducting condition is not encountered, and a detection error is eliminated.

Further, the shaped member may be formed of metal, and is fixed to the shank through an insulating member.

The shaped member is formed of metal, and is fixed to the shank through the insulating member. Therefore, the strength of the shaped member and particularly the strength of the incomplete insertion-detecting projection are increased, and this prevents a disadvantage resulting from the breakage of the incomplete insertion-detecting projection.

Features and advantages of the invention will be evident from the following detailed description of the preferred embodiments described in conjunction with the attached drawings.

DETAILED DESCRIPTION OF THE PREFERRED EMBODIMENTS

Figure 1:
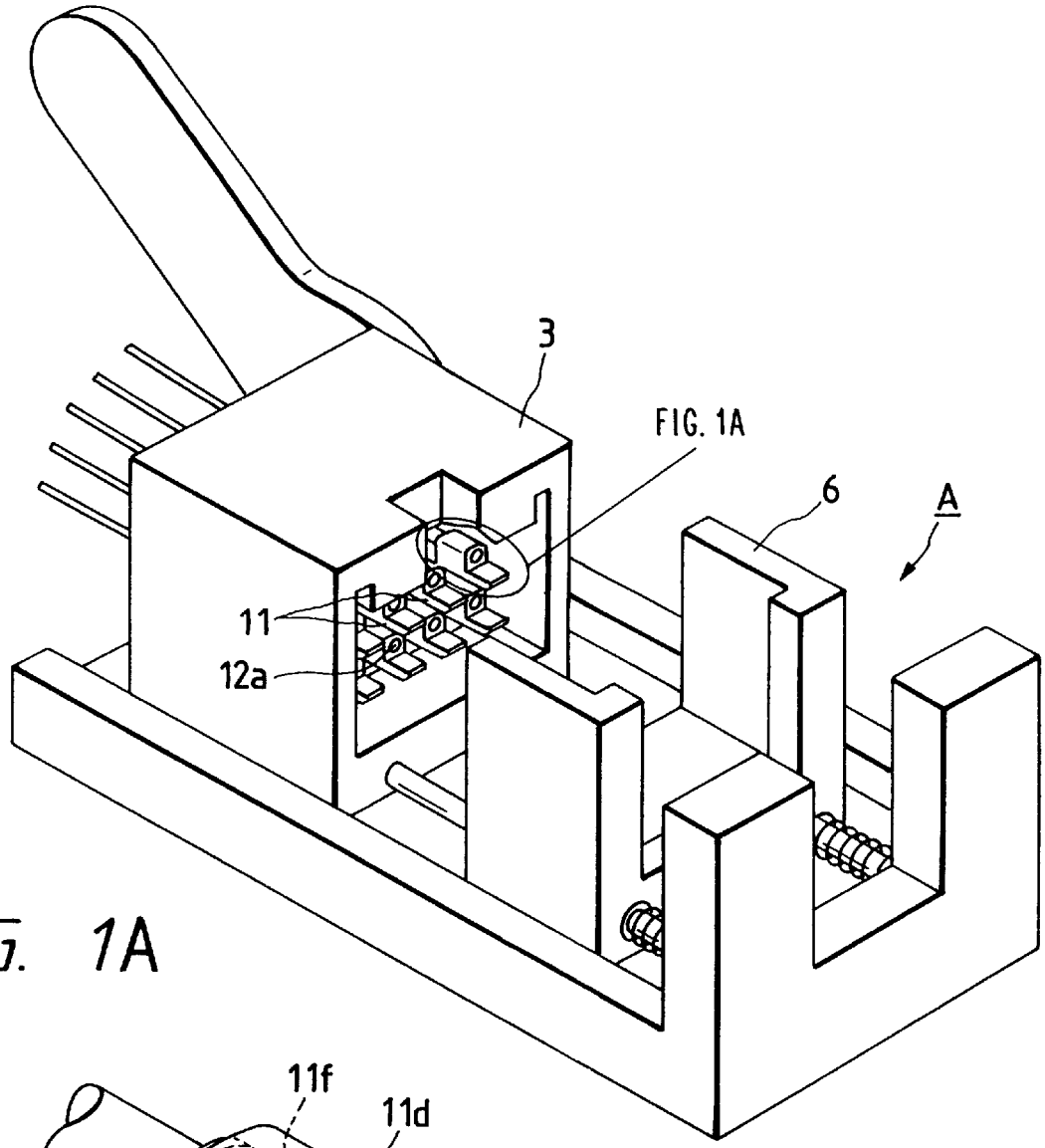
FIG. 1 and FIG. 1A are perspective views of one preferred embodiment of a connector examination instrument of the present invention.
Figure 1A:
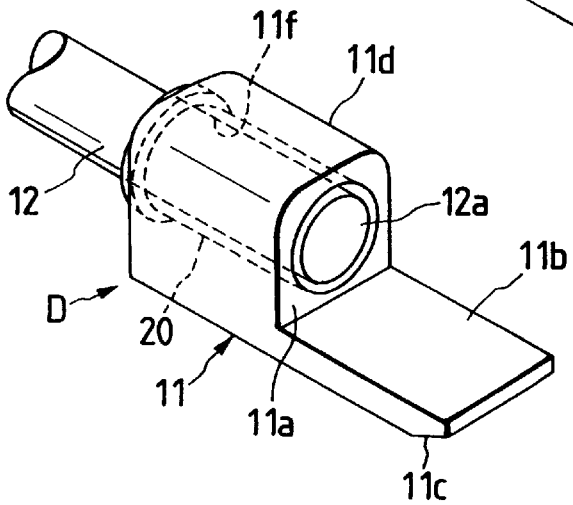
Figure 2:
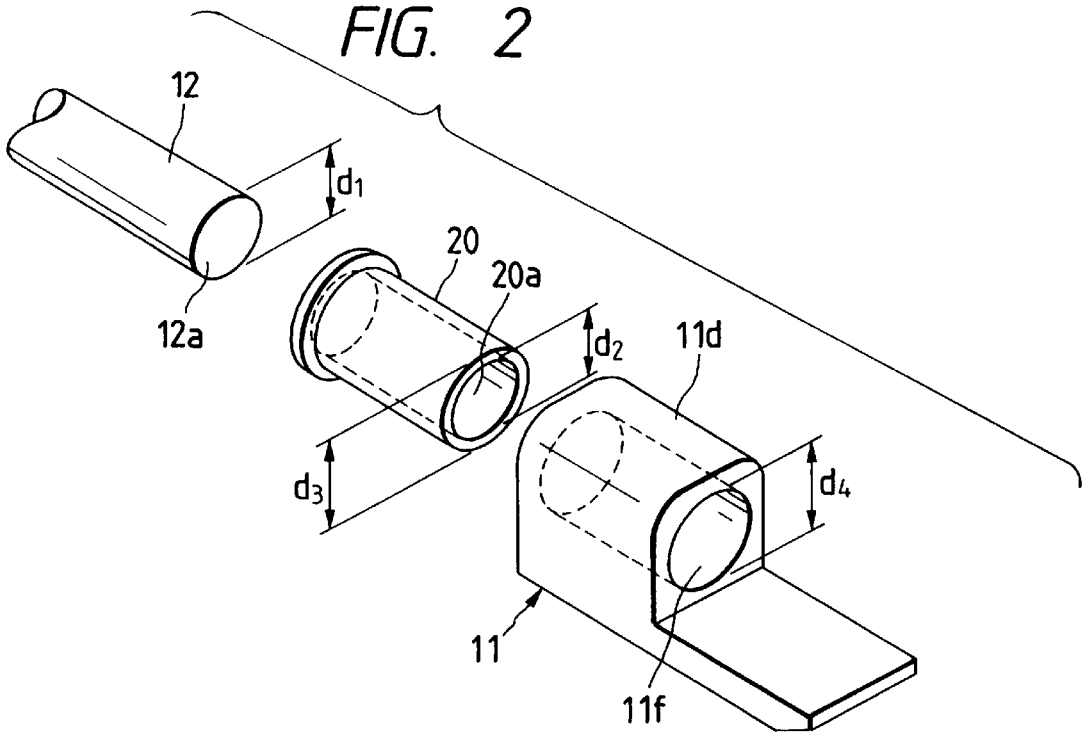
FIG. 2 is an exploded, perspective view of an examination pin.
Figure 3:
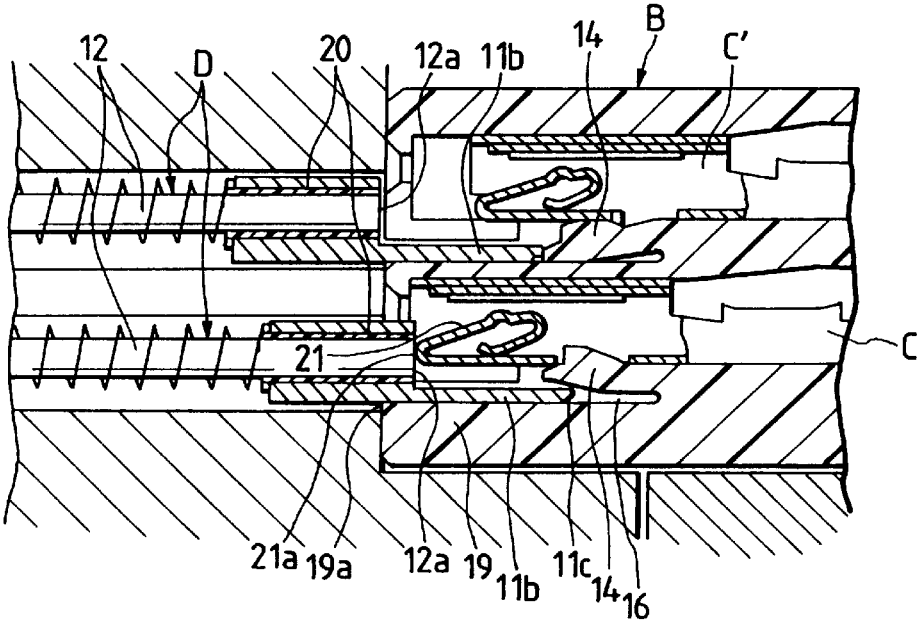
FIG. 3 is a vertical cross-sectional view of an important portion, showing a condition in which a connector is examined.
Figure 4:
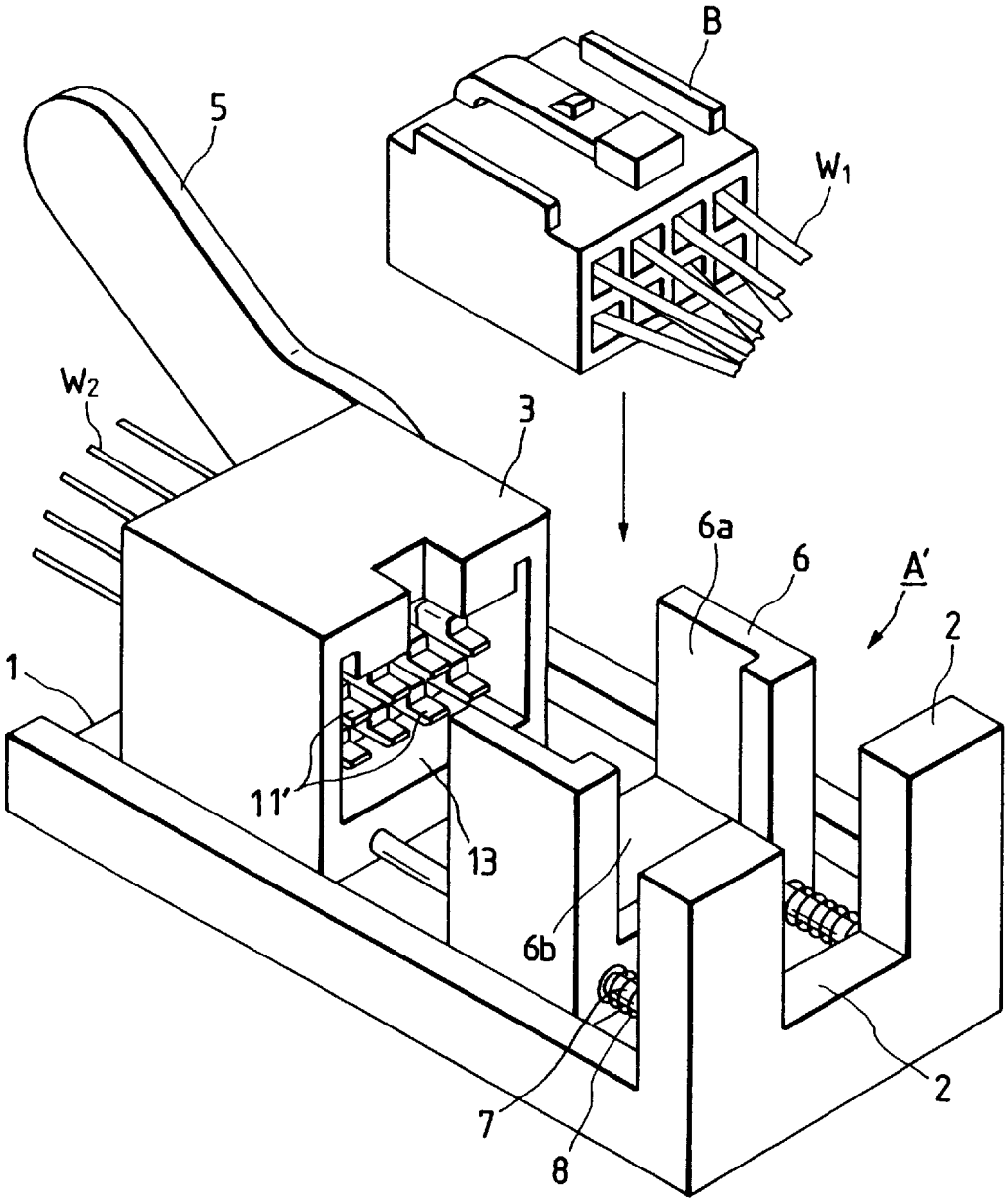
FIG. 4 PRIOR ART
FIG. 4 is perspective view of a conventional connector examination instrument.
Figure 5:
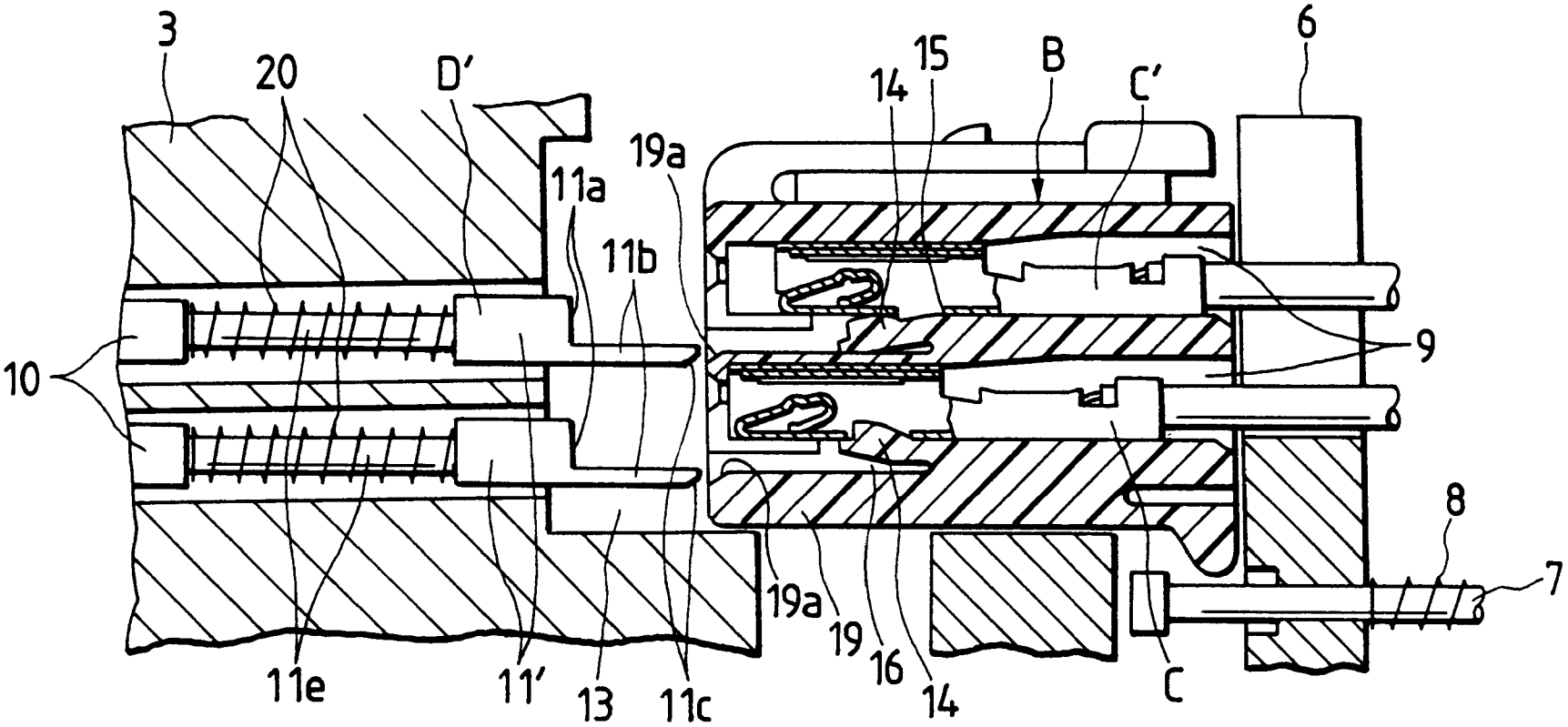
FIG. 5 PRIOR ART
FIG. 5 is a vertical cross-sectional view showing a condition in which a connector is set in the connector examination instrument.
Figure 6:
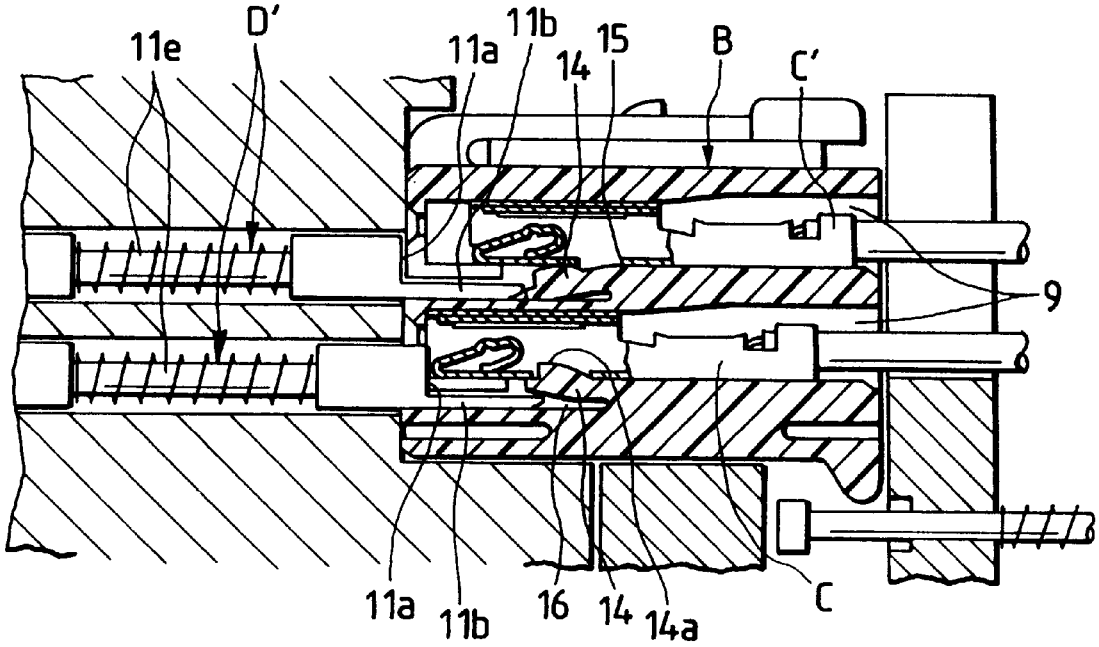
FIG. 6 PRIOR ART
FIG. 6 is a vertical cross-sectional view showing a condition in which the connector is examined.

FIGS. 1 to 3 show one preferred embodiment of a connector examination instrument of the present invention.

In this connector examination instrument A, a plurality of examination pins D are slidably mounted within an examination instrument body 3, and are urged toward a connector support member 6 by springs (FIG. 3). Each examination pin D comprises a shank 12 made of electrically-conductive metal, and a shaped member 11 of metal fixedly secured to a distal end portion of the shank 12 through an insulating member 20.

The shank 12 is formed, for example, by cutting a round bar of a copper alloy into a predetermined length, and the shaped member 11 is fixedly secured to the shank 12 through the insulating member 20. The insulating member 20 has elasticity, and is formed of an electrically-insulating material such as resin, and has a cylindrical shape having an insertion hole 20*a* for receiving the shank 12. The shaped member 11 includes a head 11*d* of a generally square cross-section, having an insertion hole 11*f* for receiving the insulating member 20, and an incomplete insertion-detecting projection 11*b* which is formed on and extends forwardly from a lower portion of a distal end of the head 11*d*. The head 11*d* and the incomplete insertion-detecting projection 11*b* are formed integrally with each other.

As shown in FIG. 2, an outer diameter $d_1$ of the shank 12 is slightly larger than an inner diameter $d_2$ of the insertion hole 20*a* in the insulating member 20. The shank 12 is press fitted into the insertion hole 20*a*, so that the insulating member 20 is fixed to the shank 12. An outer diameter $d_3$ of the insulating member 20 is slightly larger than an inner diameter $d_4$ of the insertion hole 11*f* in the shaped member 11. The insulating member 20, fitted on the shank 12, is press fitted into the insertion hole 11*f* in the shaped member 11, so that the insulating member 20 is fixed to the head 11*d* of the shaped member 11. A distal end surface 12*a* of the shank 12 lies flush with a distal end surface 11*a* of the head 11*d* of the shaped member 11, and therefore is exposed, and this exposed surface serves as a conducting contact surface for contact with a distal end 21*a* of a contact spring piece portion 21 of a metal terminal C (FIG. 3).

Figure 7:
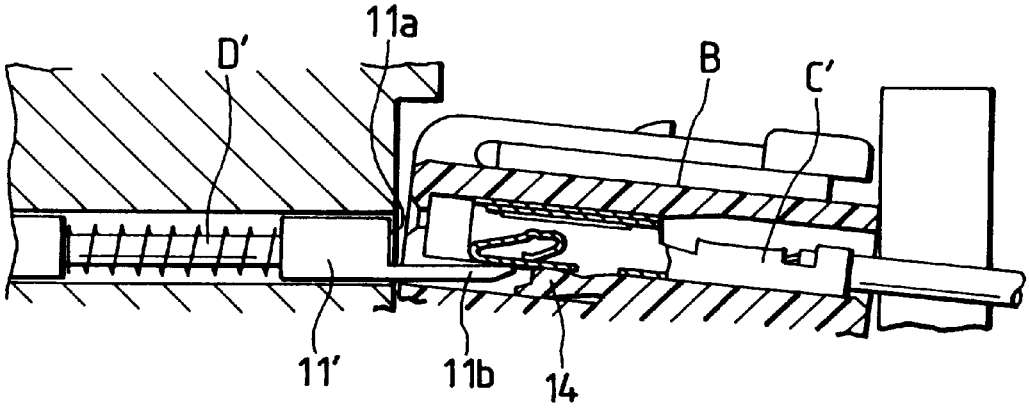
FIG. 7 is a view explanatory of a detection error.

The shank 12 and the shaped member 11 are fixed to each other through the insulating member 20, and therefore even if the examination pin D is inserted obliquely, so that the incomplete insertion-detecting projection 11*b* is brought into contact with the metal terminal C as described above for FIG. 7, a conducting condition is not encountered, and therefore a detection error is eliminated.

In the above embodiment, the shaped member 11 is formed of metal and the insulating member is provided between the shank 12 and the shaped member 11. It is also possible to integrally form the shaped member 11 with an electrically-insulating material such as resin. In this case, the insulating member 20 can be omitted if the shaped member 11 is fixedly secured to the shank 12.

The shank of the examination pin and the insulative shaped member are formed separately from each other, and the two are connected together by press fitting or the like. Therefore, even if the examination pin is inserted obliquely, so that the incomplete insertion-detecting projection of the shaped member is brought into contact with the metal terminal, a conducting condition is not encountered, and a detection error is eliminated.

The shaped member may be formed of metal, and is fixedly secured to the shank through the insulating member. Therefore, the strength of the shaped member and particularly the strength of the incomplete insertion-detecting projection are increased, and this prevents a disadvantage resulting from the breakage of the incomplete insertion-detecting projection.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A connector examination instrument comprising:

a connector support member;

an examination instrument body being provided for movement toward and away from said connector support member; and examination pins slidably mounted within said examination instrument body and being spring-biased toward said connector support member, each of said examination pins including a conducting contact surface for contact with an associated metal terminal within a connector and an incomplete insertion-detecting projection for insertion into a flexure space for an elastic retaining piece portion for retaining the metal terminal, said examination pin comprising:

a shank having an exposed distal end serving as said conducting contact surface; and an insulative shaped member being fixedly secured to a distal end portion of said shank and having said incomplete insertion-detecting projection.

2. A connector examination instrument comprising:

a connector support member;

an examination instrument body being provided for movement toward and away from said connector support member; and examination pins slidably mounted within said examination instrument body and being spring-biased toward said connector support member, each of said examination pins including a conducting contact surface for contact with an associated metal terminal within a connector and an incomplete insertion-detecting projection for insertion into a flexure space for an elastic retaining piece portion for retaining the metal terminal, said examination pin comprising:

a shank having an exposed distal end serving as said conducting contact surface;

an insulating member being fixedly secured to a distal end portion of said shank; and a metal shaped member being fixedly secured to a distal end portion of said shank through said insulating member and having said incomplete insertion-detecting projection.

* * * * *